United States Patent [19]

Kozlov et al.

[11] Patent Number: 4,976,472

[45] Date of Patent: Dec. 11, 1990

[54] CENTRIFUGAL MILL

[76] Inventors: Vladimir I. Kozlov, ulitsa Karbysheva, 26, kv. 7; Vladimir F. Redkin, ulitsa Kirenskogo, 24, kv. 230; Sergei A. Kozyrev, prospekt Mira, 107, kv. 10; Vasily N. Borisov, ulitsa Baumana, 14, kv. 14, all of Krasnoyarsk; Vladimir V. Boldyrev, ulitsa Tereshkovoi, 38, kv. 29, Novosibirsk; Fedor R. Krebel, ulitsa Kirenskogo, 24, kv. 216; Nikolai M. Rubtsov, prospekt Krasnoyarsky rabochy, 127a, kv. 196, both of, Krasnoyarsk, all of U.S.S.R.

[21] Appl. No.: 347,890

[22] PCT Filed: Aug. 25, 1987

[86] PCT No.: PCT/SU87/00091

§ 371 Date: Apr. 15, 1989

§ 102(e) Date: Apr. 15, 1989

[87] PCT Pub. No.: WO89/01824

PCT Pub. Date: Mar. 9, 1989

[51] Int. Cl.[5] ..... B02C 17/16

[52] U.S. Cl. ..... 241/172

[58] Field of Search ..... 241/171, 172, 173, 184, 241/103, 110, 117, 131, 176

[56] References Cited

U.S. PATENT DOCUMENTS 3,709,442 1/1973 Consoli ..... 241/103 X
3,840,190 10/1974 Consoli ..... 241/117

FOREIGN PATENT DOCUMENTS 512263 10/1971 Switzerland .
395111 1/1974 U.S.S.R. .
925386 5/1982 U.S.S.R. .

*Primary Examiner*—Mark Rosenbaum
*Attorney, Agent, or Firm*—Lilling and Lilling

[57] ABSTRACT

A centrifugal mill having a feeder secured on a housing, the working surface of which has ribs and which accommodates a separator mounted on a shaft and arranged coaxially inside the housing to define an annular clearance with the working surface of the housing and having a cavity and a plurality of through holes in a side wall and balls placed in the cavity of the separator, some of the balls interacting during rotation of the separator with the ribs of the housing via the through holes in the side wall of the separator, the cavity of the separator accommodating a baffle defining with the separator an annular clearance of between 0.1 and 1.0 times the diameter of the ball, the annular clearance between the separator and working surface of the housing amounting to between 0.1 and 0.5 times the diameter of the ball, whereas the through holes in the separator have the form of slots.

11 Claims, 3 Drawing Sheets

CENTRIFUGAL MILL

BACKGROUND OF THE INVENTION

1. Field of the Invention

This invention relates to comminutaing materials, and more particularly to centrifugal mills.

The invention can find application in the mining, construction and chemical industries for dispersing and mechanochemical activation of solids, and also in research facilities for modelling automated production lines and for facilitating solutions associated with problems before science and technology.

2. Description of the Related Art

There is known a centrifugal ball mill of continuous action (SU, A, 395111) comprising a stationary housing having a cylindrical inner surface, a vibration feeding means, and separators rotatable on a shaft and having balls freely inserted into grooves and accurately locked in planes substantially perpendicular to the axis of rotation by the separators, the diameter of the balls reducing and the number of such balls increasing in the direction of feeding the material to be comminuted.

Comminution of materials in a continuous action centrifugal ball mill is based on crushing the material particles at the points of contact of the balls to which centrifugal forces caused by rotation of the separators are exerted with the cylindrical inner wall of the housing.

A characteristic feature of the centrifugal mill of this type is low power of impact pulses produced by the milling balls oscillating exclusively due to the lack of stability of their travel on the layer of material moving along the inner surface of the housing; in addition, the material tends to stick to the cylindrical wall of the housing to form a soft base, which reduces communition efficiency, hampers the flow of the material, and affects the function of the balls.

There is also known a continuous action centrifugal mill (cf., SU, A, 925386) comprising a feeder secured on a housing having a ribbed working surface and accommodating a separator arranged coaxially on a shaft and including a cavity filled with balls. A side wall of the separator has through holes corresponding to the diameter of the milling balls which enter the through holes during rotation of the separator to engage with the ribs of the housing.

This centrifugal mill operates as follows. Centrifugal forces generated due to rotation of the separator displace the balls to the inner wall of the separator and the balls are piled in a row of layers. Therewith, part of the balls in the layer adjacent to the wall enter the through holes of the separator. These balls are caused to roll and slide on the working surface of the housing periodically hitting the ribs, whereby the impact energy is transferred to the rest of the balls present in the cavity of the rotating separator, which due to different geometrical and dynamic conditions of interaction move randomly. Importantly, the greater the number of balls charged to the cavity of the separator, the higher is the frequently of ball interaction and the smaller is the distance they fly between impacts. Conversely, a reduction in the charge of balls in the cavity of the separator results in less frequent interaction between the balls, a greater distance they travel between the impacts, and longer time periods between impacts.

The initial material delivered from the feeder to the cavity of the separator is acted upon by the turbulent flows of air and randomly moving balls, and is forced via the through holes of the separator, which are open at points in time following the impacts of the balls, against the ribs on the working surface of the housing. The material is preliminarily treated in the cavity of the separator due to the dynamic interaction of the randomly moving balls, whereas the main and subsequent treatment stages of the material are based on collision of the balls against the ribs of the working surface of the housing. Therefore, the designation of balls randomly moving in the cavity of the separator is limited exclusively to ensuring a more prompt return of the balls present in the through holes of the separator to the working surface of the housing subsequent to their recoil from the ribs. At the same time, while performing this function, the balls present in the cavity of the separator obtain rotation pulses as they interact with the balls in the through holes to result in friction therebetween as well as in a loss of energy and wear of the balls. In addition, the balls present in the through holes of the separator are in contact with the walls of the through holes about an arc, which also promotes losses of energy for friction. Reducing the number of balls in the cavity of the separator causes less energy lost for friction, although extends the time of flight of the balls present in the through holes to consequently result in a reduction in the frequency of impacts delivered on the working surface of the housing. The random movement of the balls present in the cavity and in the through holes of the separator accelerates wear of the balls, slows down the comminution process and activation accompanied by losses of energy and failure to provide stable periodical vibration impact movement of balls at a high frequency of their interaction with the material being comminuted.

In addition, the heretofore described construction of the centrifugal mill in the horizontal or inclined positions fails to provide the sufficient level of activation and comminution fineness due to non-uniform distribution of the material at the top and bottom parts of the working surface of the housing.

In the case of vertical arrangement of the axis of the mill, accelerated velocity of the material under the forces of gravity reduces the dwelling time of the material at the working surface to result in less efficient material comminution process. When comminutins viscous materials, the output capacity of the mill tends to reduce, because the material adheres to the working surfaces to result in slowing down its movement toward the discharge hole. Also, this mill construction fails to provide uniform delivery of reagents directly to the working zone in the desired percentage.

SUMMARY OF THE INVENTION

The invention aims at providing a centrifugal mill ensuring steady and periodic vibration action of balls with a high impact frequency necessary for efficiently carrying out processes associated with dispersion, mechanical and chemical activation of materials through modifying the mill structurally.

The aims of the invention can be materialized in a centrifugal mill comprising a feeder secured on a housing, the working surface of which accommodates a separator mounted on a shaft and arranged coaxially inside the housing to define an annular clearance with the working surface of the housing. The feeder has a cavity and a plurality of through holes in a side wall, and balls are placed in the cavity of the separator, some of the balls interacting during rotation of the separator with the ribs of the housing via the through holes in the side wall of the separator. The cavity of the separator accomodates a baffle defining with the separator an annular clearance of between 0.1 and 1.0 times the diameter of the ball, the annular clearance between the separator and working surface of the housing amounting to between 0.1 and 0.5 the diameter of the ball, whereas the through holes in the separator have the form of slots.

Preferably, the baffle of the centrifugal mill, according to the invention, is mounted on a shaft arranged coaxially with the shaft of the separator.

The arrangement of the baffle in the separator, the side wall of which has slots, as well as the provision of annular clearances ensure periodic vibration impacts of balls with a very high frequency of impacts delivered by the balls against the working surfaces to consequently result in more efficient comminution and activation, as well as in improved kinematics of the processes.

Preferably, the baffle has a cavity for feeding reagents thereto.

Advisably, the side wall of the baffle is provided with nozzles for feeding the reagents from the cavity of the baffle to the cavity of the separator.

Desirably, the nozzles are of variable cross-section.

Favorably axis of the nozzles are at an angle to the axis of rotation of the baffle.

Importantly, the nozzles in the side wall of the baffle are arranged about a helical line.

In view of the aforedescribed, the provision of the cavity in the baffle ensures uniform delivery of reagents to the nozzles. The abovedescribed arrangement of the nozzles improves homogenization and cleaning of all the working surfaces from the material sticking thereto.

Preferably, the baffle is fabricated from metal ceramics.

This reduces losses of energy from deformation as the ball hits the baffle due to the increased modulus of elasticity of the metal ceramics as compared with other materials, which in turn promotes an increase in the share of energy expendable directly on the material treatment at the invariable level of the overall amount of energy delivered for the process, thereby increasing the efficiency of dispersion and activation.

Advisably, each slot in the side wall of the separator diverges toward the axis of rotation of the separator.

Favorably each successive slot is offset relative to the preceding slot and to an end face of the separator.

Such arrangement of the slots provides point contact of the balls with the driving wall of the separator slot, prevents repeated collisions of the balls with the driving wall, and enables uniform distribution of the balls on the working surface of the housing to thereby reduce losses of energy from friction, slow down wear of all engaging surfaces, and extend the service life of the centrifugal mill.

BRIEF DESCRIPTION OF THE DRAWINGS

The invention will now be described in greater detail with reference to a specific preferred embodiment thereof taken in conjunction with the accompanying drawings, in which.

DESCRIPTION OF THE PREFERRED EMBODIMENT

Figure 1:
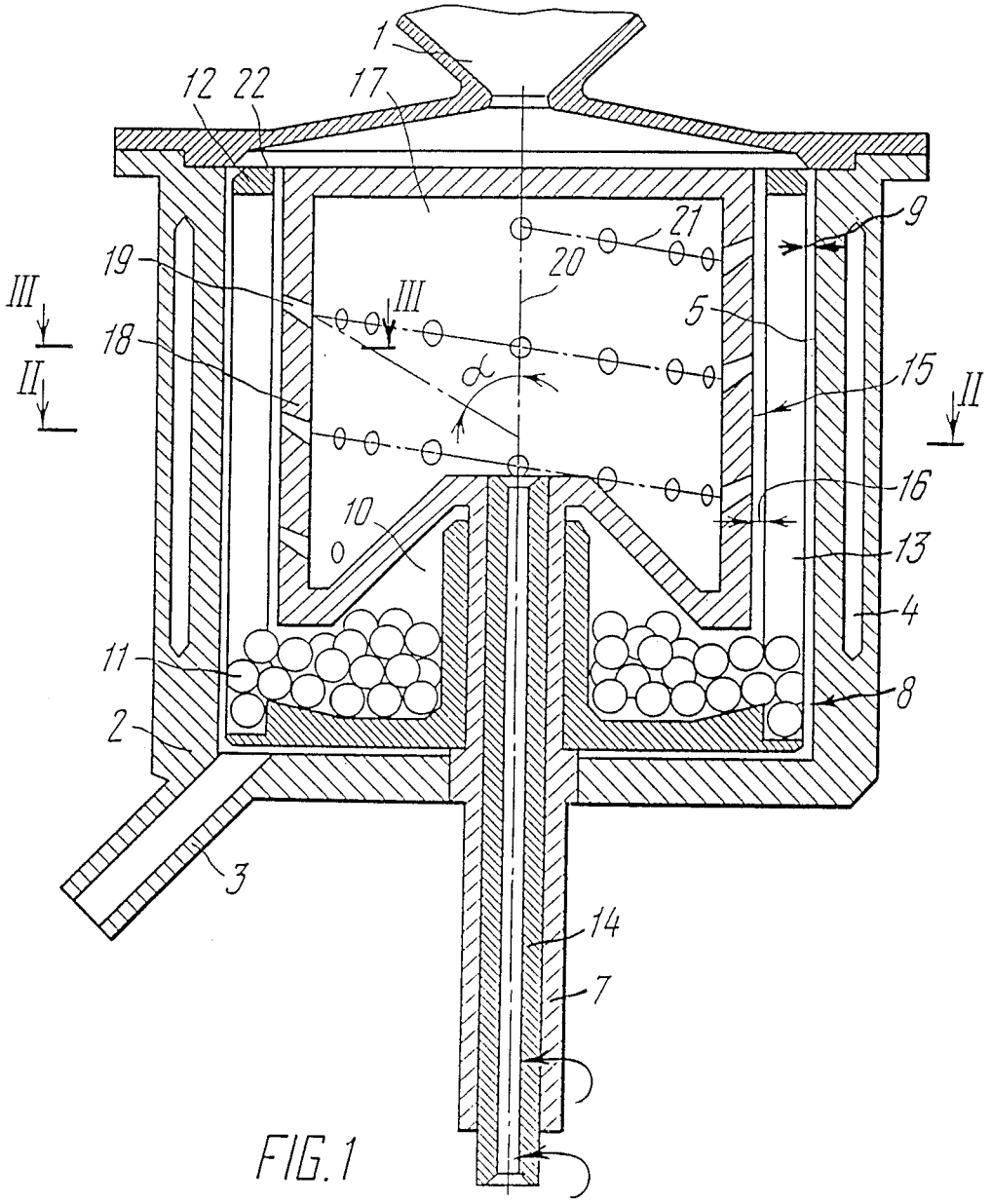
FIG. 1 is a longitudinal sectional view of a centrifugal mill according to the invention.
Figure 2:
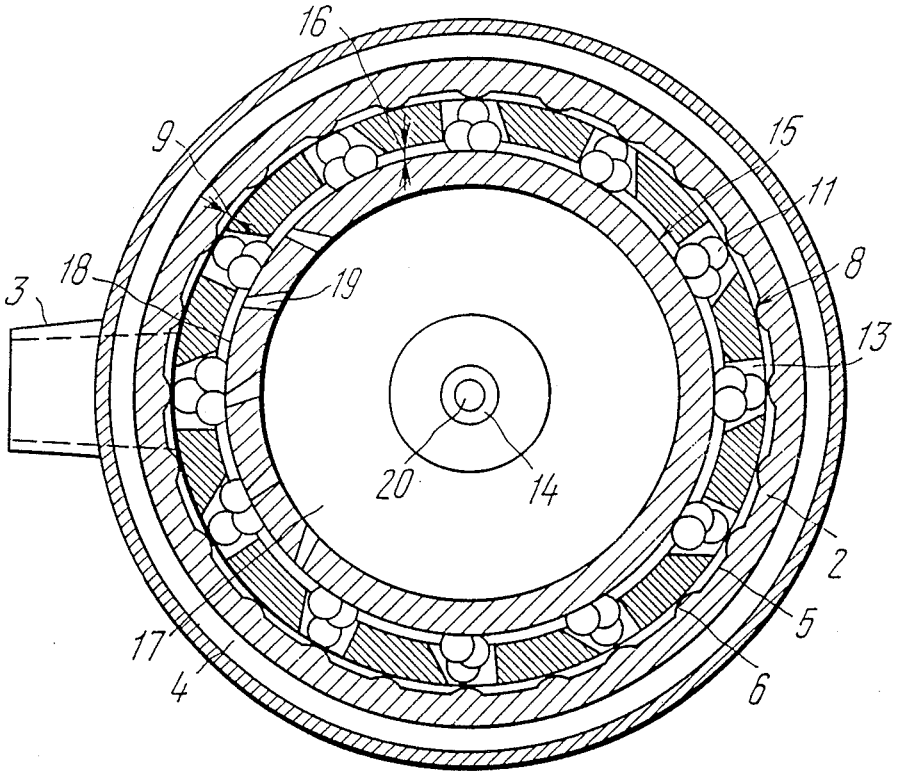
FIG. 2 shows a section taken along the line II—II of the centrifugal mill represented in FIG. 1.

A centrifugal mill comprises a feeder 1 (FIG. 1) secured on a fixed housing 2 having a pipe 3 for discharging the material, and a cooling cavity 4, an inner working surface 5 of which has ribs 6 (FIG. 2). Mounted coaxially in the housing 2 (FIG. 1) on a shaft 7 is a separator 8 defining with the working surface 5 of the housing 2 an annular clearance 9. The separator 8 has a cavity 10 occupied by balls 11, whereas a side wall 12 has through holes in the form of slots 13.

Figure 3:
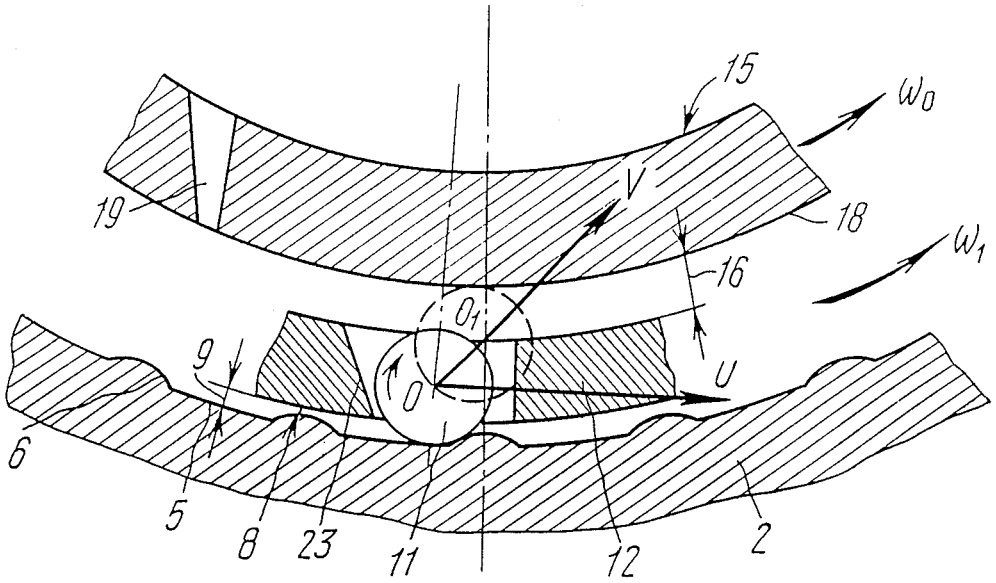
FIG. 3 shows the position of a ball as it hits the rib of the housing, a section taken along the line III—III of the mill shown in FIG. 1.

The cavity 10 of the separator 8 accommodates coaxially a baffle 15 to the shaft 7 of the separator, an annular clearance 16 being defined between the separator 8 and baffle 15. The annular clearance 9 amount is 0.1 to 0.5 the diameter of the ball 11, whereas the annular clearance 16 amount is between 0.1 and 1.0 times the diameter of the ball 11. The baffle 15 has a cavity 17, whereas the shaft 14 of the baffle 15 is hollow to facilitate feeding of reagents. The side wall 18 of the baffle 15 has nozzles 19 of variable cross-section with axes of these nozzles set at an angle to the axis 20 of rotation of the baffle 15, the nozzles in the side wall 18 being arranged about a helical line 21. Each slot in the side wall 12 of the separator 8 diverges toward the axis of rotation of the separator 8 coinciding with the axis 20 of rotation of the baffle; each successive slot 13 is offset relative to the preceding slot 13 and to an end face 22 of the separator 8, each such slot 13 being further arranged in parallel with the axis of rotation of the separator and having a wall 23 (FIG. 3), which is a driving wall.

The centrifugal mill operates in the following manner. A drive (not shown) rotates the separator 8 (FIG. 1). The balls 11 present in the cavity 10 are forced centrifugally to the periphery, that is the balls are caused to enter the slots 13 made in the side wall 12 of the separator 8 to spread uniformly along the slots 13 and initiate a steady and periodic vibration impact movement in a space confined by the working surface 5 of the housing 2, slots 13 of the rotating separator 8 and side wall 18 of the baffle 15 rotatable through engagement with the balls 11.

The initial material delivered through the feeder 1 is caused by the action of centrifugal forces and turbulent air flows to be thrown onto the working surface 5 of the housing 2, spread uniformly thereon, and moved to the discharge pipe 3, while being subjected to impacts delivered by the balls 11. The material is therefore caused partially to break, and partially to store energy in the form of disturbed crystal lattice, i.e., is subjected to activation.

In addition, gaseous or liquid reagents are delivered from a source (not shown) along the hollow shaft 14 to the cavity 17 of the baffle 15 to be then fed onto the working surface 5 and to the annular clearances 9 and 16 through the nozzles 19 of variable cross-section set at an angle to the axis 20 of rotation and along the helical line 21. Having accelerated in the nozzles 19 of variable cross-section, the reagents are thrown against the surface of the balls 11, wall 23, slots 13 of the separator 8, and the working surface 5 of the housing 2 to act on the material adhering thereto and clean them, whereas the jets of gas or liquid tend to entrain the material providing thereby its movement, improving homogenization, and saving the reagents.

Figure 4:
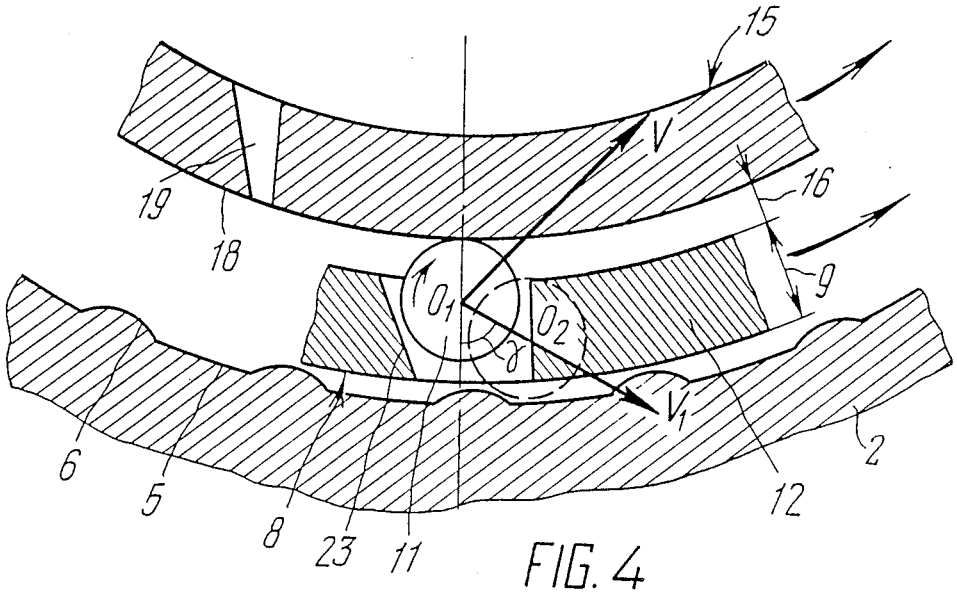
FIG. 4 shows the same as in FIG. 3 illustrating the position of the ball as it hits the baffle.

Kinematics of the balls 11 will now be considered. The separator 8 (FIG. 3) rotates at an angular velocity $\omega_1$, the wall 23 thereof forcing or pushing the ball 11, which after rolling on the working surface 5 of the housing 2 collides with the rib 6 at a velocity u. Due to the impact engagement with the rib 6 the ball changes direction of travel, and moving along the straight line $00_1$ at a velocity $v$ hits the side wall 18 of the baffle 15 to again change direction, moving along the straight line $0_10_2$ (FIG. 4) at a velocity $v_1$ and colliding with the working surface 5 of the housing 2. Then the cycle of movement of the ball 11 is repeated after hitting the next rib 6.

The provision of rigid baffle wall 15 (FIGS. 1, 2) mounted inside the cavity 10 of the separator 8 facilitates the return of the balls 11 to the working surface 5 of the housing 2 subsequent to the impact on the ribs 6, increases the frequency of engagement of the balls 11 with the material being treated, and improves the kinetic characteristics of the process of comminution or activation.

The baffle wall 15, fabricated from metal ceramics and containing tungsten alloys and posessing a high modulus of elasticity, reduces losses of energy of the ball 11 associated with plastic deformation during impact, which promotes an increase in the share of energy expended directly for treating the material at an invariable amount of energy delivered to the machine, whereby the efficiency of dispersion and activation is increased.

Because the baffle wall 15 is secured on the shaft 14 coaxially with the shaft 7 of the separator 8, the impacts of the ball 11 on the side wall 18 of the baffle wall 15 are accompanied by transfer of energy of the moving ball 11 to the baffle wall 15 to rotate the latter which acquires an angular velocity $\omega_o$ at steady operating conditions.

Therewith, the transfer of energy from the ball 11 executing translational and rotational motion is minimized, since the linear velocities of points at the surface of the ball 11 and points at the surface of the side wall 18 of the baffle 15 are equalized, and relative slipping at the contact points is reduced to consequently result in a reduction in the loss of energy due to friction.

With the stable angular velocity $\omega_o$ of the baffle wall 15, the ball 11 after collision with the wall 18 moves at an angle $\gamma$ (FIG. 4) to a radius circumscribed through the point of impact to the working surface 5 of the housing 2. As a result, the material being treated is subjected to impacts from the balls 11 mainly at invariable relations between compression and shearing stresses.

In order to change the relationship between such stresses, the shaft 14 imparts to the baffle wall 15 (FIG. 1) an angular velocity different from the angular velocity $\omega_o$ and corresponding to conditions of free rotation of the baffle wall 15 heretofore described. With this aim in view, the shaft 14 is linked with a drive (not shown).

In the course of dynamic interaction with the baffle 15 the ball 11 tends to change its angular velocity of rotation relative to its own axis and linear velocity in the direction of recoil to act on the material, thereby causing a change in relationship between the directions of compression and shear, which results in changing conditions of comminution and activation, and consequently expands the functional capabilities of the proposed mill.

The annular clearance 16 between the baffle 15 and separator 8 amounting to between 0.1 and 1.0 times the diameter of the ball 11 is necessary for vibration impact movement. When the annular clearance 16 is less than 0.1 times the diameter of the ball 11, the separator 8 and the baffle 15 get jammed by starting material particles with the result that the separator 8 starts to operate in jerks, which consequently causes unstable and non-periodic vibration impact movement of the balls 11 whereby the efficiency of the process of comminution or activation is reduced.

Conversely, the annular clearance 16 of over 1.0 times the diameter of the ball 11 causes jamming of the balls 11 between the side wall 18 of the baffle 15 and the inner surface of the side wall 12 of the separator 8, or, alternatively, may result in the movement of the ball 11 from one slot 13 to another. In consequence, the vibration impact movement of the balls 11 may be disturbed to cause jamming of the balls 11 in the slots 13.

Provision of the annular clearance 9 between the separator 8 and working surface 5 of the housing 2 of 0.1 to 0.5 times the diameter of the ball 11 is dictated by the general relationship between the size of the balls 11 and the particles of material being comminuted of approximately 1:10, that is with the size of the ball 11 of 100 mm across, the size of the material being comminuted is 10 mm. In addition, particle size of less than 0.1 times the diameter of the ball 11 causes reduced efficiency of material treatment, since in this case the reaction of the ball 11 on the driving wall 23 will approximate the line connecting the axis of rotation 20 and the geometrical center of the ball 11, and upon collision with the particles of the material the ball 11 will tend to travel along the path of the least resistance, viz., it will be forced to the slot 13, failing to comminute the material particles. If the size of the annular clearance 9 exceeds 0.5 the diameter of the ball 11, the latter will operate under precompression, which will be accompanied by added losses of energy due to friction between the driving wall 23 and ball 11 and fast wear thereof.

In view of the foregoing, the provision of annular clearances within the aforedescribed range ensures dispersion and activation of the material being comminuted accompanied by steady and periodic vibration impacts exerted by the balls at a high frequency.

In addition, the slots 13 of the separator 8 diverging toward the axis 20 of rotation of the separator 8 and baffle wall 15 also ensure vibration impact movement of the balls 11, and reduction of losses due to friction as the ball 11 hits the rib 6, to result in reduced wear of the wall 23 of the separator 8.

Displacement of the slots 13 relative to one another and to the end face 22 of the separator provides uniform distribution of the balls 11 lengthwise of the working surface 5 of the housing 2 during operation, which facilitates uniform wear of the working surface 5 and ribs 6 and extends the service life of the centrifugal mill.

The invention can be used in process lines associated with comminution, mechanical and chemical activation of solids, in automated ore preparation, and in preparation of comminuted samples for express-analyses with the aim of obtaining materials with new properties.

What we claim is:

1. A centrifugal mill comprising a feeder secured on a housing having a working surface which has ribs and which accommodates a separator mounted on a shaft and arranged coaxially inside the housing to define an annular clearance with the working surface of the housing and having a cavity and a plurality of through holes in a side wall, and balls placed in the cavity of the separator, some of the balls interacting during rotation of the separator with the ribs of the housing via the through holes in the side wall of the separator, characterized in that the cavity of the separator accommodates a baffle defining with the separator an annular clearance of between 0.1 and 1.0 times the diameter of each ball, the annular clearance between the separator and working surface of the housing amounting to between 0.1 and 0.5 times the diameter of each ball, whereas through holes in the separator have the form of slots.

2. A centrifugal mill as claim 1, characterized in that the baffle is mounted on a shaft arranged coaxially with the shaft of the separator.

3. A centrifugal mill as claimed in claims 1 or 2, characterized in that the baffle has a cavity for feeding reagents thereto.

4. A centrifugal mill as claimed in claim 3, characterized in that a side wall of the baffle is provided with nozzles for feeding the reagents from the cavity of the baffle to the cavity of the separator.

5. A centrifugal mill as claimed in claim 4, characterized in that the nozzles are of variable cross-section.

6. A centrifugal mill as claimed in claim 4, characterized in that axes of the nozzles are at an angle to an axis of rotation of the baffle.

7. A centrifugal mill as claimed in claim 4, characterized in that the nozzles in the side wall of the baffle are arranged about a helical line.

8. A centrifugal mill as claimed in claim 3, characterized in that the baffle is fabricated from metal ceramics.

9. A centrifugal mill as claimed in claim 3, characterized in that each successive slot is offset relative to a preceding slot and to an end face of the separator.

10. A centrifugal mill as claimed in claim 1, characterized in that each slot in the side wall of the separator diverges toward an axis of rotation of the separator.

11. A centrifugal mill as claimed in claim 10, characterized in that each slot runs parallel with the axis of rotation of the separator.

* * * * *